US008079796B2

(12) United States Patent
Pietras

(10) Patent No.: US 8,079,796 B2
(45) Date of Patent: Dec. 20, 2011

(54) APPARATUS FOR DELIVERING A TUBULAR TO A WELLBORE

(75) Inventor: Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 722 days.

(21) Appl. No.: 10/746,174

(22) Filed: Dec. 24, 2003

(65) Prior Publication Data

US 2004/0136813 A1 Jul. 15, 2004

Related U.S. Application Data

(62) Division of application No. 09/601,643, filed on Oct. 20, 2000, now Pat. No. 6,695,559.

(30) Foreign Application Priority Data

Feb. 14, 1998 (GB) ..... 9803116.4

(51) Int. Cl.
*E21B 19/14* (2006.01)

(52) U.S. Cl. ..... 414/22.57; 414/22.58

(58) Field of Classification Search ..... 414/22.51, 414/22.52, 22.55, 22.57, 22.59, 22.54, 22.61, 414/22.64, 22.65, 22.71
See application file for complete search history.

(56) References Cited

U.S. PATENT DOCUMENTS

| | | | | |
|---|---|---|---|---|
| 2,959,371 | A * | 11/1960 | Melton | 242/375.1 |
| 3,613,905 | A * | 10/1971 | Woolslayer et al. | 414/22.55 |
| 3,655,071 | A * | 4/1972 | Langowski et al. | 414/22.58 |
| 3,780,883 | A | 12/1973 | Brown | |
| 3,795,326 | A * | 3/1974 | Neilon et al. | 414/22.58 |
| 3,902,561 | A * | 9/1975 | Friberg et al. | 175/52 |
| 4,029,215 | A | 6/1977 | Birdwell | |
| 4,172,684 | A * | 10/1979 | Jenkins | 414/22.68 |
| 4,202,653 | A * | 5/1980 | Moller | 414/22.57 |
| 4,235,566 | A | 11/1980 | Beeman et al. | |
| 4,386,883 | A * | 6/1983 | Hogan et al. | 414/22.61 |
| 4,403,898 | A | 9/1983 | Thompson | |
| 4,552,498 | A | 11/1985 | Dysarz | |
| 4,652,195 | A * | 3/1987 | McArthur | 414/22.51 |
| 4,822,230 | A * | 4/1989 | Slettedal | 414/22.54 |
| 5,127,790 | A | 7/1992 | Teague | |
| 6,098,717 | A | 8/2000 | Bailey et al. | |
| 6,527,493 | B1 * | 3/2003 | Kamphorst et al. | 414/22.57 |
| 6,695,559 | B1 | 2/2004 | Pietras | |

FOREIGN PATENT DOCUMENTS

GB 2 394 022 A 4/2004

OTHER PUBLICATIONS

GB Search Report, Application No. GB 323094.2 dated Jan. 20, 2004.

* cited by examiner

*Primary Examiner* — Charles A Fox

(74) *Attorney, Agent, or Firm* — Patterson & Sheridan, LLP

(57) ABSTRACT

An apparatus for delivering a tubular to a well center, which apparatus comprises means which, in use, inhibit swinging motion of the tubular while it is suspended from an elevator.

16 Claims, 9 Drawing Sheets

APPARATUS FOR DELIVERING A TUBULAR TO A WELLBORE

CROSS-REFERENCE TO RELATED APPLICATIONS

This application is a division of U.S. patent application Ser. No. 09/601,643, filed on Oct. 20, 2000 now U.S. Pat. No. 6,695,559, which is herein incorporated by reference.

BACKGROUND OF THE INVENTION

Field of the Invention

This invention relates to an apparatus for delivering a tubular to a well centre.

During the construction of oil and gas wells a plurality of tubulars are transferred from a storage area to the well centre. Typically, each tubular is transferred to the V-slot adjacent the rig flow by a conveyor. The tubular is then lifted by an elevator and swung into position over the well centre ready for attachment to a string of tubulars extending down the well.

One of the difficulties associated with this process is that as the elevator moves the tubular, the tubular swings back and forth like a giant pendulum. This is potentially very hazardous, particularly when handling tubulars of large diameters.

An aim of at least preferred embodiments of the present invention is to reduce this problem.

SUMMARY OF THE INVENTION

According to one aspect of the present invention there is provided an apparatus for delivering a tubular to a well centre, which apparatus comprises means which, in use, inhibit swinging motion of the tubular whilst it is suspended from an elevator.

Preferably, said means comprises an arm which is pivotable between a first position and a second position.

Advantageously, said arm is provided with a stub axle which is provided with rollers for supporting said tubular.

Preferably, the apparatus further comprises a ramp which can be placed against a rig floor, and a tray which can support a tubular and be moved along said ramp.

The ramp may define an angle with the horizontal of between 30 degrees and 70 degrees, but it is normally intended to be used at angles of from 110 to 60 degrees.

In one embodiment, said arm is mounted on said ramp.

In another embodiment, said arm is mounted on said tray.

Alternatively, the arm may be mounted on the derrick.

Advantageously, said arm is rotatable about its axis to release said tubular therefrom, for example by an hydraulic motor.

Preferably, the apparatus includes an hydraulic motor to pivot said means.

According to another aspect of the present invention, there is provided an apparatus for delivering a tubular to a well centre, which apparatus comprises a ramp which can be placed against a rig floor, a tray for carrying said tubular and means which, in use, enables said tray to ascend or descend said ramp.

Preferably, said ramp further comprises a rack.

Advantageously, said means is a pinion mounted on said tray and engageable with said rack.

The means by which the tray moves along the ramp may be of any suitable means, but is preferably a rack and pinion.

Preferably, said means comprises two pinions, one mounted adjacent each end of said tray.

Advantageously, said tray further comprises a support wheel.

Preferably, said tray further comprises a pipe sledge mounted for longitudinal movement therein.

Advantageously, said tray further comprises a pipe pusher mounted such that, in use, said pipe pusher moves said tubular longitudinally within said tray.

According to another aspect of the present invention, there is provided an apparatus for delivering a tubular to a well centre, which apparatus comprises a tray for supporting said tubular, and means which, in use, can apply a force to said tubular to move it longitudinally with respect to said tray.

Preferably, said means comprises a piston and cylinder.

Advantageously, said apparatus further comprises a ramp which can be placed against a rig floor, and a tray which can be moved along said ramp.

BRIEF DESCRIPTION OF THE DRAWINGS

For a better understanding of the present invention reference will now be made, by way of example, to the accompanying drawings, in which.

DETAILED DESCRIPTION OF THE PREFERRED EMBODIMENT

Figure 1:
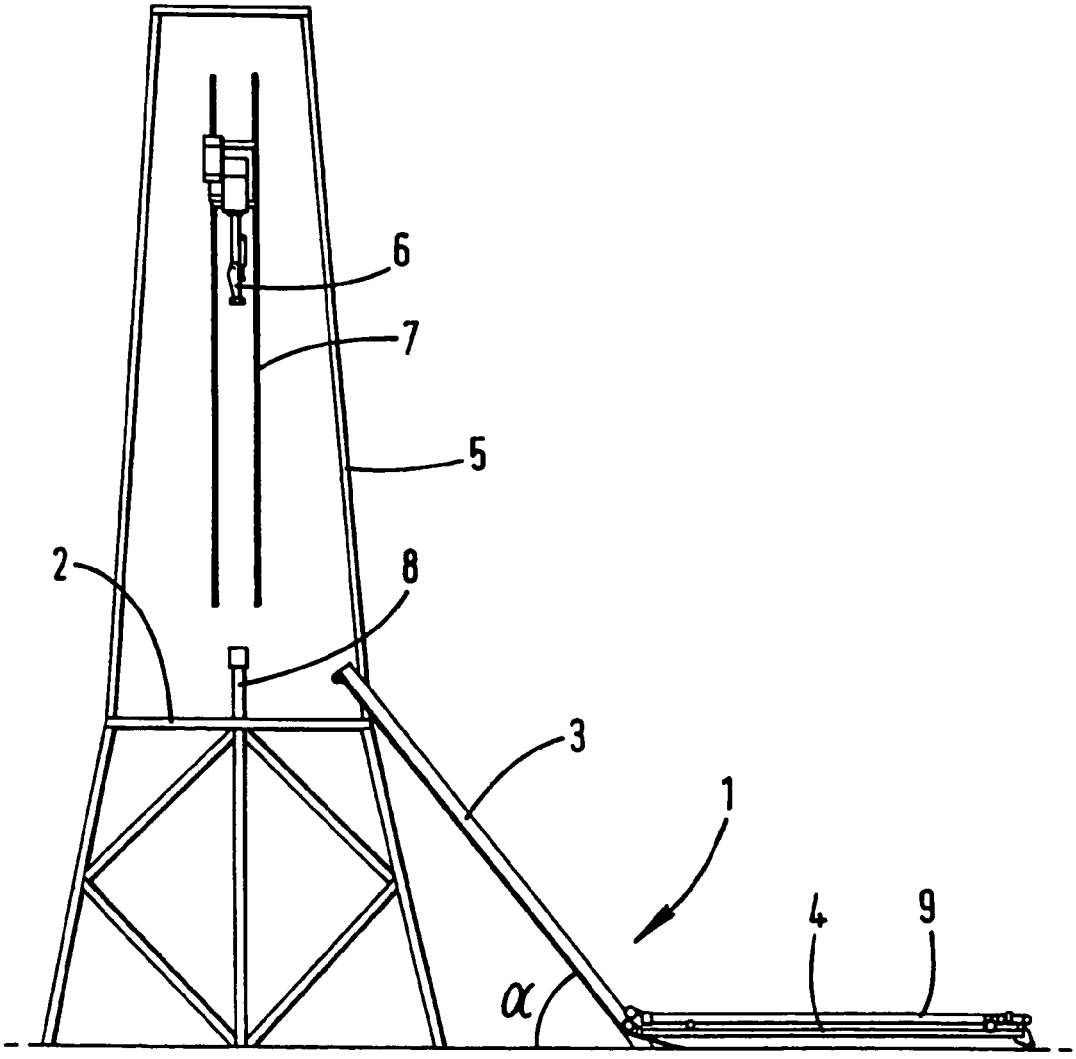
FIG. 1 is a side view of an apparatus in accordance with the present invention about to deliver a tubular to the well centre of a drilling platform.
Figure 2:
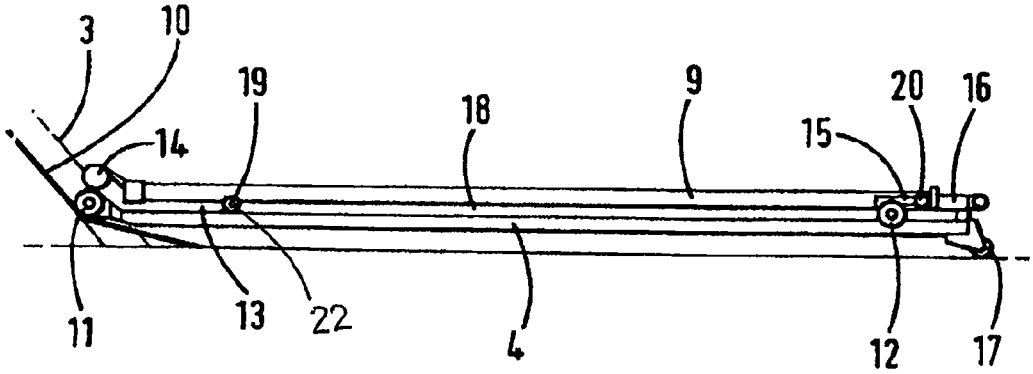
FIG. 2 is a side view, to an enlarged scale, of part of the apparatus shown in FIG. 1 with the tubular mounted thereon.

For a better understanding of the present invention reference will now be made, by way of example, to the accompanying drawings, in which:

FIG. 1 is a side view of an apparatus in accordance with the present invention about to deliver a tubular to the well centre of a drilling platform;

FIG. 2 is a side view, to an enlarged scale, of part of the apparatus shown in FIG. 1 with the tubular mounted thereon; and FIGS. 3 to 9 show successive stages in the operation of the apparatus.

Referring to FIG. 1 there is shown an apparatus which is generally identified by reference numeral 1.

The apparatus 1 comprises a ramp 3 which extends upwardly to a rig floor 2 and a pipe tray 4. The ramp 3 extends between the pipe tray 4 and a V-slot (not shown) in a derrick 5. The derrick 5 is provided with an elevator 6 which is supported from a top drive slidably mounted on a track 7.

A tubular 8 is shown within the derrick 5 having been screwed or otherwise attached to a string of tubulars (not shown) which extend down a wellbore (not shown) at the well centre. A tubular 9 is shown resting on the pipe tray 4 and is to be attached to the tubular 8 in the process of increasing the length of the string of tubulars within the wellbore.

Referring now to FIG. 2 the ramp 3 further comprises a rack 10 which extends from the lower end of ramp 3 to the upper end of ramp 3.

The pipe tray 4 further comprises two pinions 11, 12 which can be rotated by respective hydraulic motors (not shown) so that, in use, the pipe tray 4 can move either up or down the rack 10. The pinion 11 is located at one end of the pipe tray 4 whilst the pinion 12 is located at the opposite end of pipe tray 4.

A stabbing arm 13 is pivotally mounted at the end of pipe tray 4 and may be rotated by means of a swivel drive 14. Swivel drive 14 can be actuated by a hydraulic motor (not shown) to move the stabbing arm 13 between a first position shown in FIG. 2 and a second position shown in FIG. 9 as more fully described hereafter. The stabbing arm 13 is provided with a stub axle 22 which carries rollers 19 to facilitate longitudinal movement of the tubular 9.

A pipe sledge 15 resides within and at the rear end of the pipe tray 4. The pipe sledge 15 has rollers 20 mounted at each end so that in use the pipe sledge 15 can move along the longitudinal axis of the pipe tray 4.

A pipe pusher 16 which comprises a piston and cylinder is located substantially in abutment with the pipe sledge 15. The pipe pusher 16 can be hydraulically activated so that the piston of the pipe pusher 16 will exert a force on the pipe sledge 15 to move the tubular 9 longitudinally within the pipe tray 4.

Elastomeric sliding plates 18 are provided along the length of pipe tray 4 and allow the tubular 9 to rest therein. In use, the elastomeric sliding plates 18 are movable within the pipe tray 4 to help support the tubular 9.

A support wheel 17 is located at the rear end of the pipe tray 4 which, in use, allows movement of the pipe tray 4 towards the V-slot in the derrick 5.

FIGS. 3 to 9 show the apparatus in use.

Figure 3:
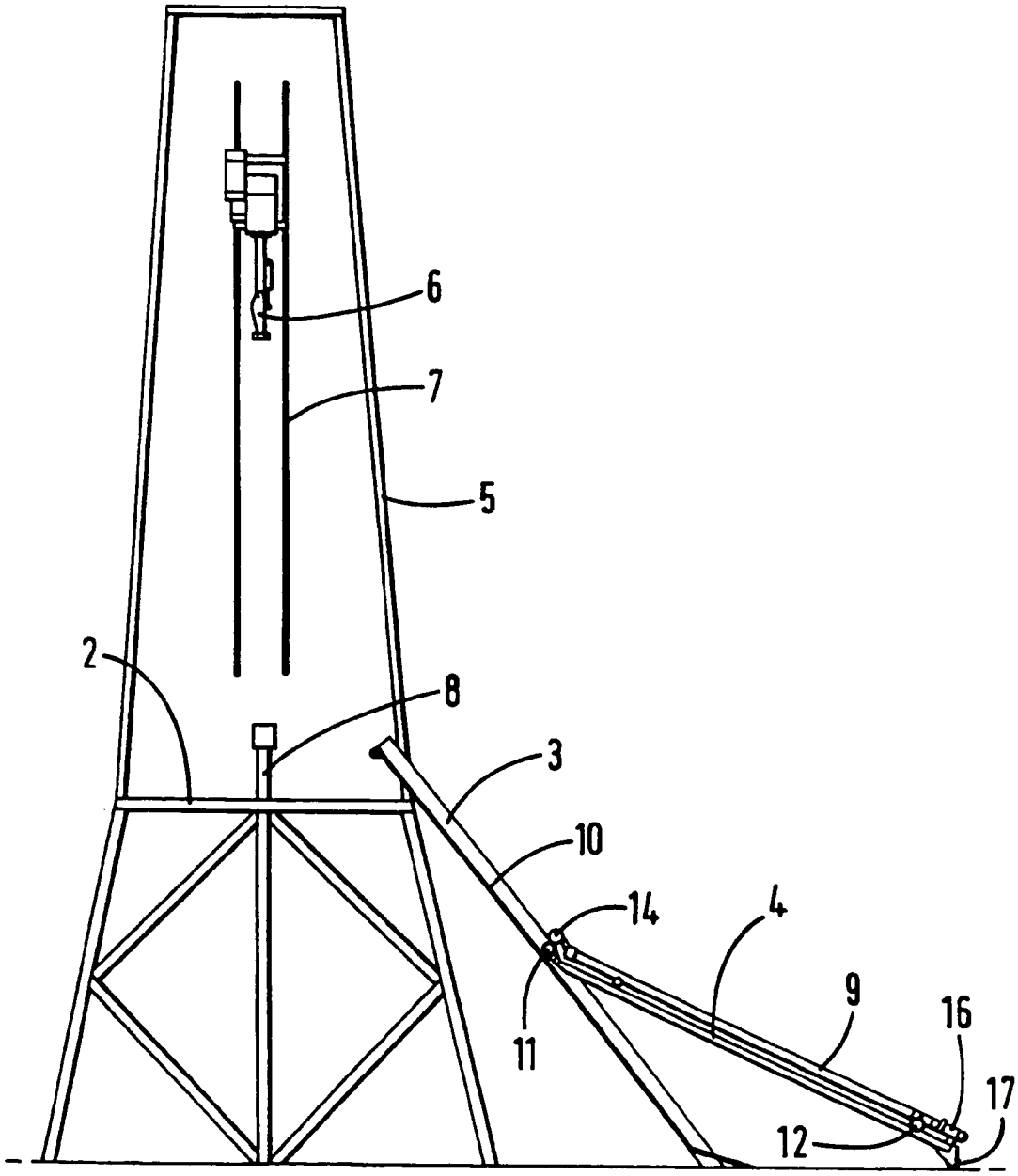
FIGS. 3 to 9 show successive stages in the operation of the apparatus.

Prior to using the apparatus 1 the tubular 9 is rolled onto the pipe tray 4 from a pipe deck (not shown). The pinion 11 is rotated. The teeth of the pinion 11 engage the rack 10 moving the pipe tray 4 toward the V-slot (not shown) in the derrick 5, as shown in FIG. 3. The pinion 12 is rotated as it nears the ramp 3 so that upon engagement with the ramp 3 the pipe tray 4 continues to move toward the V-slot in the derrick 5.

Figure 4:
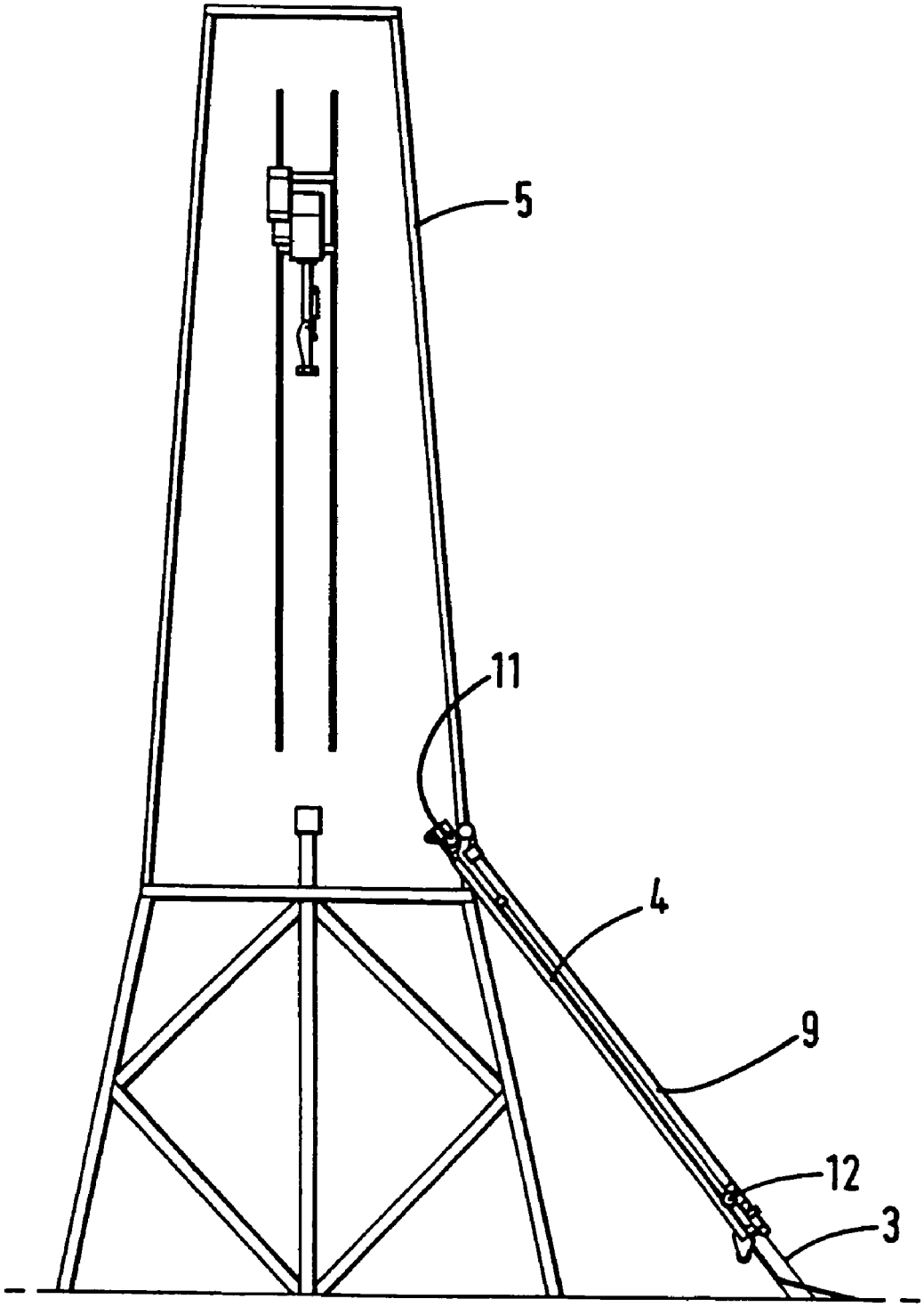
Figure 5:
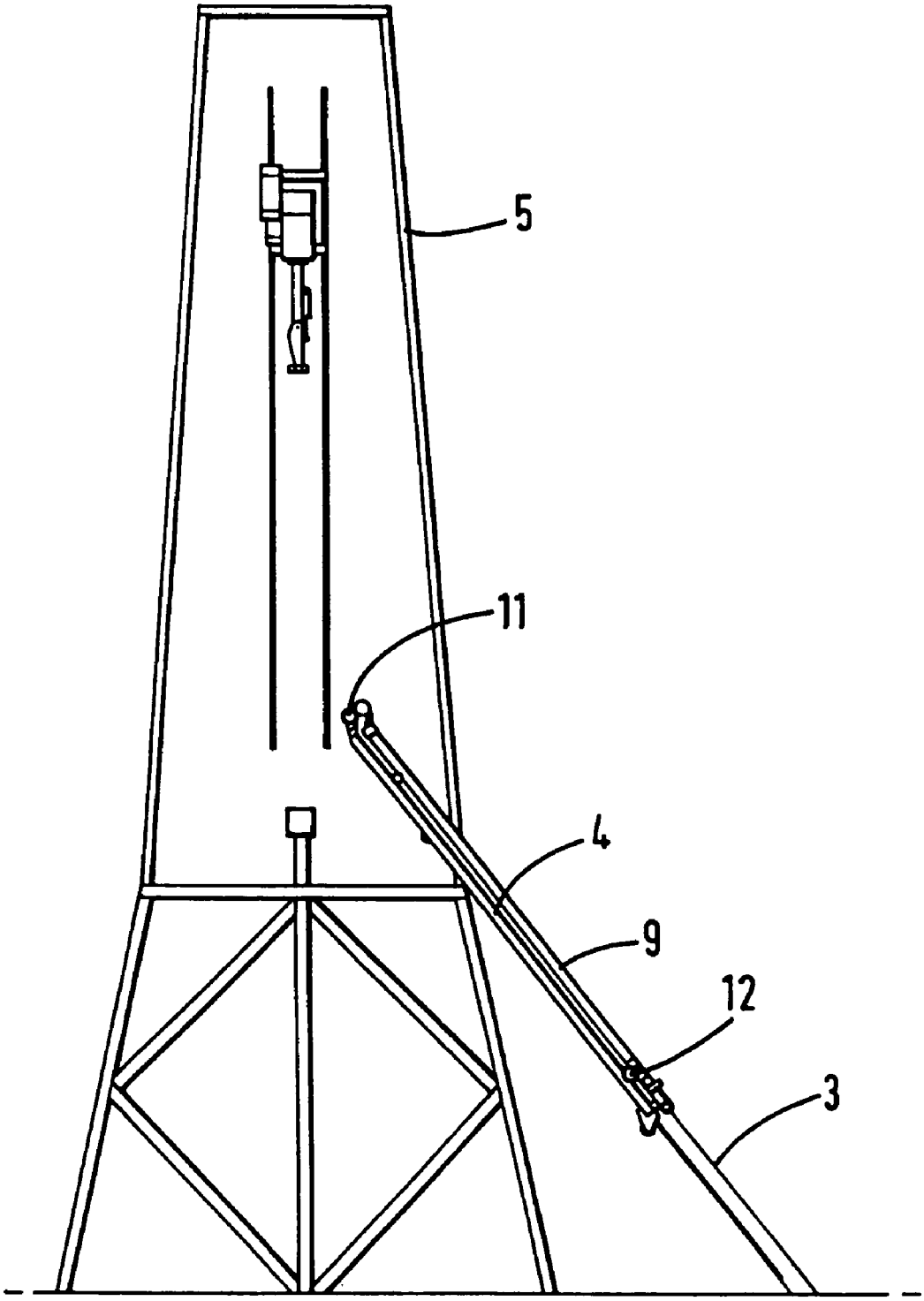

As shown in FIGS. 4 and 5 the pinion 11 has left the ramp 3 but the pipe tray 4 continues to move toward the V-slot in the derrick 5 under the effect of the pinion 12. The pinions 11, 12 are stopped when the pipe tray 4 has reached the position shown in FIG. 5.

Figure 6:
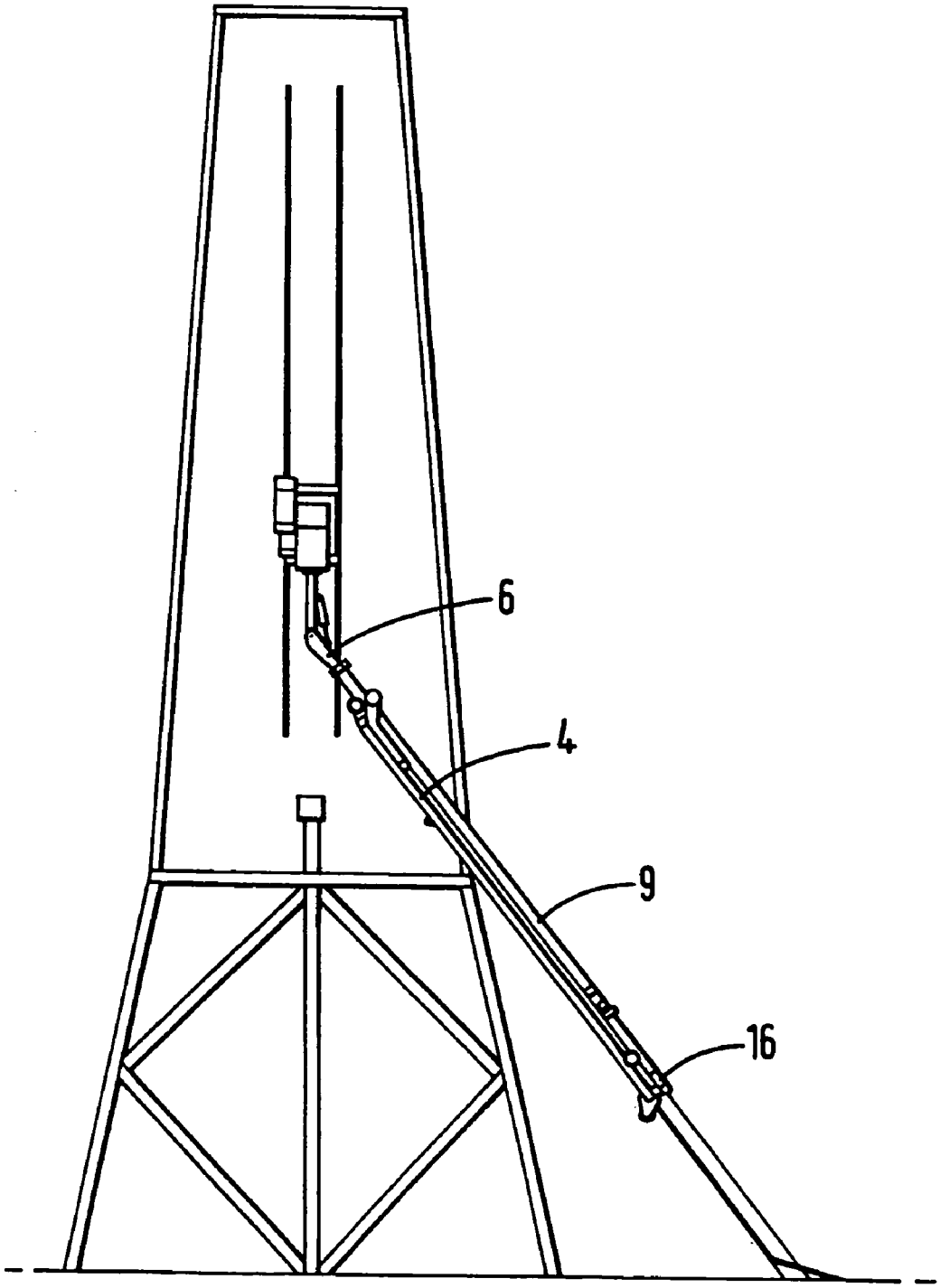

The tubular 9 is pushed out of the pipe tray 4 by extending the piston in the pipe pusher 16. The tubular 9 is pushed to a position where the elevator 6 can be easily attached to the tubular 9 as shown in FIG. 6.

Figure 7:
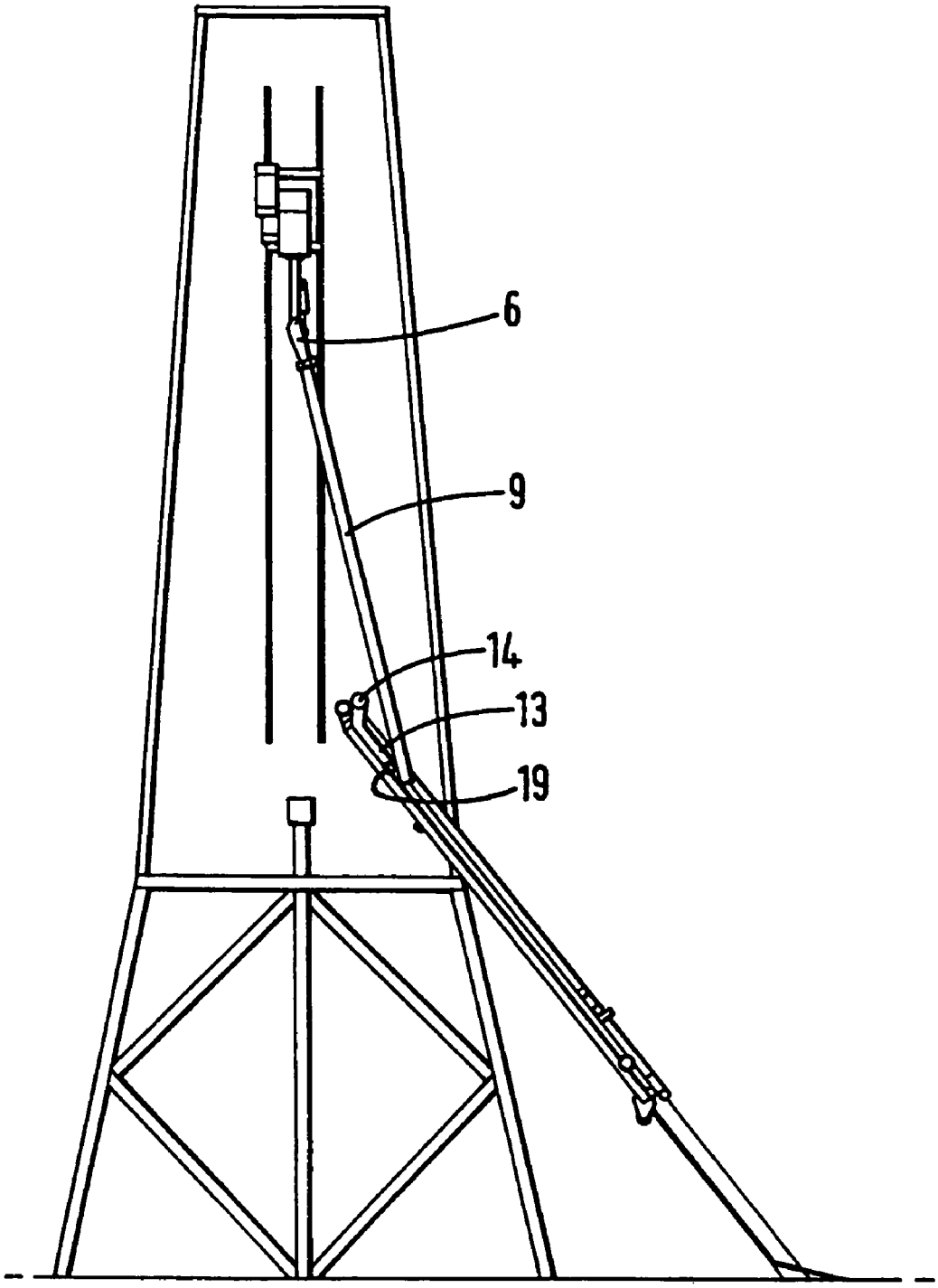
Figure 8:
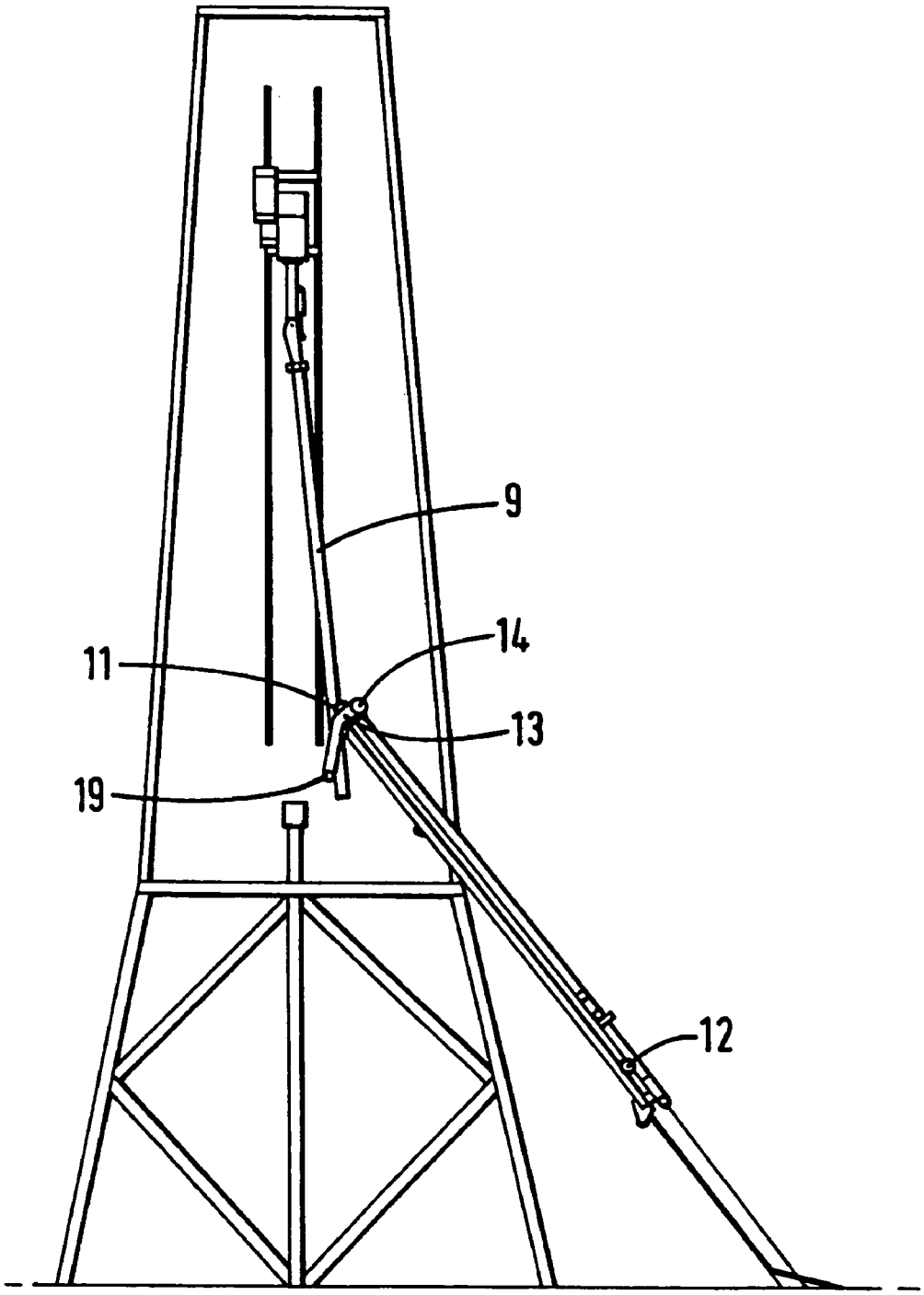

FIG. 7 shows the elevator 6 having lifted the tubular 9 to a position where the lower end of tubular 9 is near the rollers 19 of the stabbing arm 13 and the upper end is substantially above the well centre.

Figure 9:
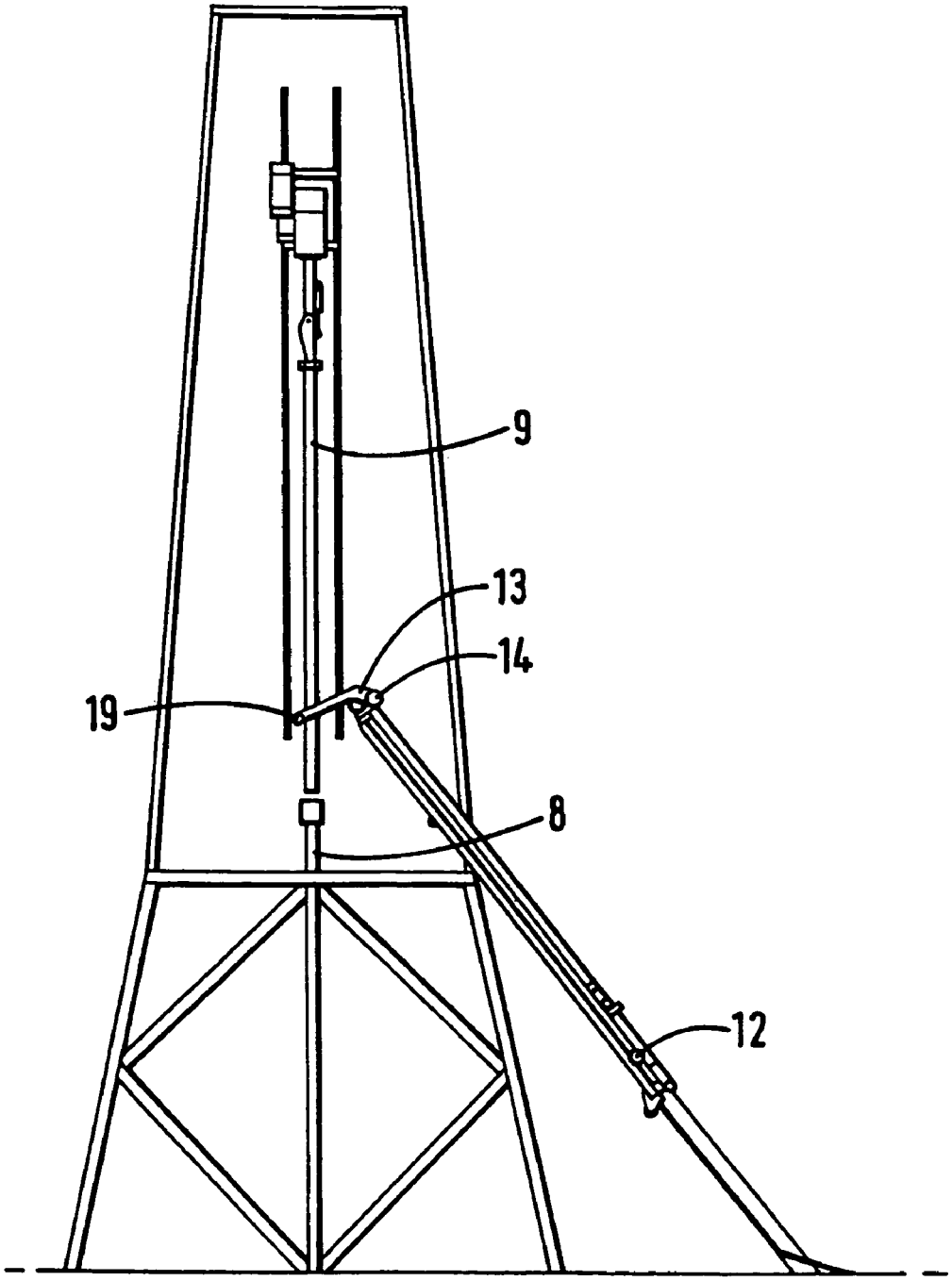

Swivel drive 14 is now engaged to rotate the stabbing lever 13 clockwise between the first position, shown in FIG. 7, and the second position, shown in FIG. 9. Movement of the stabbing lever 14 brings the longitudinal axis of the tubular 9 from an inclined position with respect to the longitudinal axis of the borehole (not shown), to a position which is substantially in alignment with the axis of the borehole (FIG. 9) (well center). The rollers 19 allow substantially vertical movement of the tubular 9. Once this is completed the stabbing lever 14 is turned through 90° so that the stabbing lever 14 may be returned to its first position. The pipe tray 4 can then return to its initial position by reversal of the pinion drives 11, 12 to collect another tubular so that the process may be repeated.

While the foregoing is directed to embodiments of the present invention, other and further embodiments of the invention may be devised without departing from the basic scope thereof, and the scope thereof is determined by the claims that follow.

The invention claimed is:

1. An apparatus for delivering a tubular to a well center, which apparatus comprises:

a pipe tray, movable with the tubular toward the well center; and an arm mounted at an end of the pipe tray and pivotable about a substantially horizontal axis, wherein the arm contacts an end portion of the tubular and is configured to pivotably move the tubular from a first position where a longitudinal axis of the tubular is in an inclined position with respect to a longitudinal axis of the well to a second pivoted position where the longitudinal axis of the tubular is substantially in alignment with the longitudinal axis of the well;

a motor for pivoting the arm, wherein the arm is configured to move the tubular toward the well independent of movement of the pipe tray; and a roller to guide vertical movement of the tubular relative to the arm.

2. The apparatus of claim 1, wherein the roller is carried by a stub axle and supports said tubular.

3. The apparatus of claim 1, further comprising an inclined ramp which can be placed against a rig floor, wherein said pipe tray and said arm which can support a tubular and be moved along said ramp.

4. The apparatus of claim 1, wherein the motor is a hydraulic motor configured to pivot the arm.

5. An apparatus for delivering a tubular to a well center on a rig floor, from a position substantially below the rig floor, the apparatus comprising:

an arm having an axle at a distal end and is operatively mounted to an inclined ramp member and is pivotable around a pivot point to move the tubular between a first position where the longitudinal axis of the tubular is in an inclined position with respect to the longitudinal axis of a well and a second position where the longitudinal axis of the tubular is substantially in alignment with the axis of the well, wherein the axle is in contact with the tubular as the axle pivots and guides the tubular between the first position and the second position; and a motor configured to pivot the arm, wherein the arm is configured to move the tubular toward the well independent of movement of the inclined ramp member.

6. The apparatus of claim 5, wherein the arm is configured to pivot about a substantially horizontal axis.

7. The apparatus of claim 5, wherein the axle is provided with rollers for supporting said tubular.

8. An apparatus for delivering a tubular to a well center, which apparatus comprises:

a pipe tray adapted to move the tubular toward the well center; and an arm mounted on the pipe tray and pivotable about a substantially horizontal axis, wherein the arm is configured to move the tubular toward the well independent of movement of the pipe tray;

a guide member coupled to the arm for contacting and guiding the tubular while the arm rotates about its axis to move the tubular from a first position on the pipe tray to a second position away from the pipe tray.

9. The apparatus of claim 8, further comprising a ramp which can be placed against a rig floor, wherein the pipe tray and the arm is movable along the ramp.

10. The apparatus of claim 9, wherein movement of the pipe tray along the ramp moves the tubular from a substantially horizontal position to an inclined position.

11. The apparatus of claim 9, wherein the ramp includes a rack adapted to engage a pinion on the pipe tray.

12. The apparatus of claim 8, further comprising a pipe pusher adapted to move the tubular along a length of the pipe tray.

13. An apparatus for delivering a tubular to a well center, comprising:

a ramp;

a pipe tray movable along the ramp to move the tubular toward the well center, wherein an angle between the pipe tray and the pipe ramp changes as the pipe tray moves along the ramp; and an arm having an axle and is mounted on the pipe tray and pivotable about a substantially horizontal axis to move the tubular from a first position on the pipe tray to a second position away from the pipe tray, wherein the axle is in contact with and guides downward movement of the tubular, wherein the arm is configured to move the tubular toward the well independent of movement of the pipe tray.

14. The apparatus of claim 13, further comprising a pipe pusher adapted to move the tubular along a length of the pipe tray.

15. The apparatus of claim 13, wherein a distal end of the arm is movable from a first location above the pipe tray to a second location below the pipe tray.

16. The apparatus of claim 13, wherein the axle is provided with rollers for supporting said tubular.

* * * * *